US006749018B1

(12) United States Patent
Ford et al.

(10) Patent No.: US 6,749,018 B1
(45) Date of Patent: Jun. 15, 2004

(54) BIT RUN AND RETRIEVAL WEAR BUSHING AND TOOL

(75) Inventors: David L. Ford, Katy, TX (US); Bill Mair, New Iberia, LA (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/717,870

(22) Filed: Nov. 21, 2000

(51) Int. Cl.[7] ..... E21B 23/00; E21B 23/01
(52) U.S. Cl. ..... 166/85.3; 166/208; 166/85.5
(58) Field of Search ..... 166/85.3, 208, 166/85.1, 75.14, 240, 206, 214

(56) References Cited

U.S. PATENT DOCUMENTS

| | | | | |
|---|---|---|---|---|
| 5,025,864 A | | 6/1991 | Nobileau | 166/348 |
| 5,044,438 A | * | 9/1991 | Young | 166/382 |
| 5,163,514 A | * | 11/1992 | Jennings | 166/206 |
| 5,199,495 A | | 4/1993 | Brammer et al. | 166/339 |
| 5,360,063 A | | 11/1994 | Henderson, Jr. | 166/208 |

* cited by examiner

*Primary Examiner*—David Bagnell
*Assistant Examiner*—Daniel P Stephenson
(74) *Attorney, Agent, or Firm*—Bracewell & Patterson, L.L.P.

(57) ABSTRACT

A wear bushing has a lower portion that is landed on a casing hanger in a wellhead housing. An upper portion of the wear bushing has a shear ring in a locking profile that locks the wear bushing to the casing hanger. A locking ring resides in a bore of the wear bushing and has passages for fluid flow. The inner surface of the locking ring has teeth for engaging the teeth of a running tool when the tool is moved upward relative to the wear bushing. A plurality of locking keys extend radially inward through the bore of the wear bushing beneath the locking ring. A beveled ridge on the tool mates with the locking ring. The wear bushing is mounted to the tool which is joined to a drill string. With the locking keys locked on the tool, the wear bushing is lowered down the well into the wellhead housing. The wear bushing is landed on the casing hanger and the locking pins are pressed upward as they contact a seal assembly. The wear bushing is rotated until the locking pins align and fall into slots. With the locking pins in the slots, the wear bushing cannot be rotated relative to the casing hanger. The tool is released from the wear bushing by opposite rotation, and the tool may then be run deeper into the well.

19 Claims, 3 Drawing Sheets

BIT RUN AND RETRIEVAL WEAR BUSHING AND TOOL

BACKGROUND OF THE INVENTION

1. Technical Field

The present invention relates in general to an improved wear bushing, and in particular to an improved bit run and retrieval wear bushing and tool.

2. Description of the Prior Art

A wear bushing is used in drilling applications to protect the inner profiles of the various components in the wellhead. In the prior art, wear bushings typically have been run or lowered down to the wellhead on a separate trip. One type of bit run wear bushing is held to a tool via shear pins. This bit run wear bushing has an internal ledge with a reduced inner diameter for retrieval. However, the tools used to run and retrieve the wear bushings occasionally release the wear bushings prematurely, and do not have full opening through the wear bushing. Thus, an improved bit run wear bushing would be desirable.

SUMMARY OF THE INVENTION

A wear bushing has a lower portion that is landed on a casing hanger in a wellhead housing. The upper end of the lower portion of the wear bushing has a shear ring in a locking profile that locks the wear bushing to the casing hanger. A locking ring resides in a bore of the wear bushing and has passages for fluid flow. The inner surface of the locking ring has teeth for engaging the teeth of a running tool when the tool is moved upward relative to the wear bushing. The ring is designed so that the only profile moving up or down in the drill string that will engage the ring is the profile on the tool. A plurality of locking keys extend radially inward through the bore of the wear bushing beneath the locking ring. The keys are designed to allow free rotation of the tool relative to the wear bushing in only one direction. A beveled ridge on the tool mates with the locking ring.

The wear bushing is mounted to the tool which is joined to a drill string. With the locking keys locked on the tool, the wear bushing is lowered down the well into the wellhead housing. The wear bushing is landed on the casing hanger and the locking pins are pressed upward as they contact a seal assembly. The wear bushing is rotated until the locking pins align and fall into slots. With the locking pins in the slots, the wear bushing cannot be rotated relative to the casing hanger. The tool is released from the wear bushing by more rotation and a downward force on the tool that will expand the C-ring and release the tool, and the tool may then be run deeper into the well.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

Figure 1:
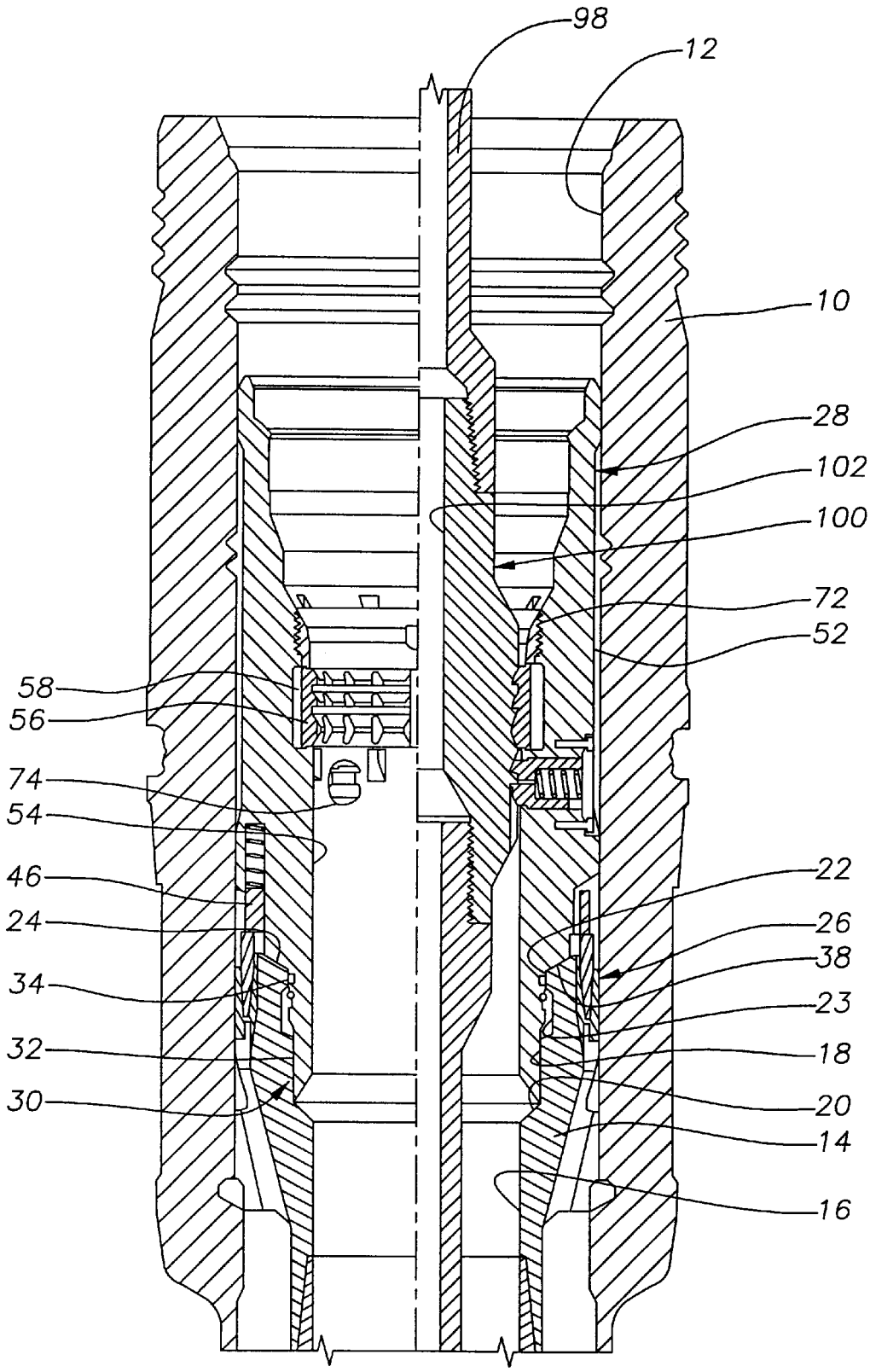
FIG. 1 is a sectional side view of a wear bushing constructed in accordance with the present invention and landed in a wellhead, with the right side showing a running tool engaged in the wear bushing.

Referring to FIG. 1, a subsea wellhead has a tubular outer wellhead housing 10 with an inner bore 12. Inner bore 12 concentrically accepts a casing hanger 14 that lands in housing 10. Casing hanger 14 has a bore extending through it, with a lower section 16 separated from a middle section 18 by a conical shoulder 20. The middle section 18 has a larger diameter than lower section 16. An upper section 22 of larger diameter than middle section 18 is located above middle section 18. There is a recess 23 with a diameter greater than upper section 22 between upper and middle sections 22, 18. The upper end of casing hanger 14 has a conical rim 24 that slopes downward and inward. A conventional seal assembly 26 seals the annular space between casing hanger 14 and inner bore 12.

Figure 2:
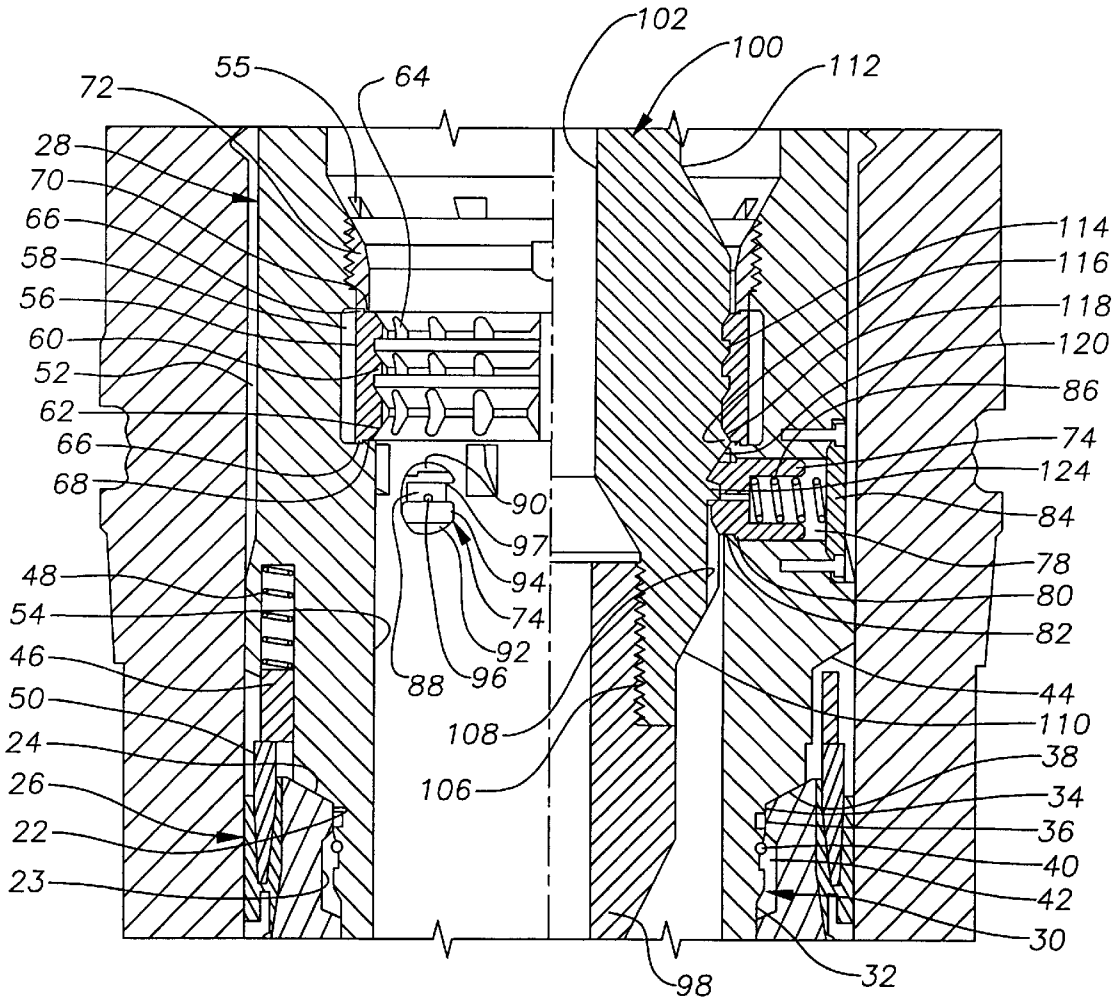
FIG. 2 is an enlarged sectional view of the wear bushing and running tool of FIG. 1.

A wear bushing 28 constructed in accordance with the present invention lands in casing hanger 14. Wear bushing 28 is a generally tubular member and has a landing portion 30 on its lower end. Landing portion 30 has a lower portion 32 adapted to be tightly accepted in middle section 18. As shown in FIG. 2, landing portion 30 has an upper portion 34 adapted to be tightly accepted in upper section 22 and carries a seal 36 which seals against upper bore 22. A landing shoulder 38 is positioned above upper portion 34 such that when landing shoulder 38 rests on rim 24, lower portion 32 is concentrically accepted into middle section 18 of casing hanger 14 and upper portion is concentrically accepted into upper section 22.

Referring to FIG. 2, the upper portion 34 has a shear ring 40 in a locking profile 42 that locks wear bushing 28 to casing hanger 14. Profile 42 is known in the art and adapted to allow landing portion 30 to stab into casing hanger 14 without shearing shear ring 40. Shear ring 40 then resides in recess 23 and must be sheared to pull wear bushing 28 apart from casing hanger 14.

A downward facing ledge 44 located above landing shoulder 38 retractably houses at least one locking pin 46. Locking pin 46 is urged downward by spring 48 and is adapted to engage slot 50 in the upper end of seal assembly 26. With locking pin 46 engaged in seal assembly 26, wear bushing 28 cannot be rotated relative to the casing hanger 14.

Wear bushing 28 extends upward from ledge 44 with an outer diameter that is slightly smaller than the diameter of bore 12. A central recessed portion 52 of wear bushing 28 has an outer diameter that is smaller than that of bore 12. An inner bore 54 of wear bushing 28 has a diameter that is substantially equal to the diameter of lower bore 16 in casing hanger 14. As shown in FIG. 1, the lower edge of inner bore 54 is chamfered.

A C-shaped locking ring 56 resides in a transverse recess 58 in inner bore 54. A plurality of communication passages 55 are cut in bore 54 across recess 58, allowing flow of fluids around locking ring 56. The outer diameter of locking ring 56 is smaller than the inner diameter of recess 58, thereby enabling locking ring 56 to expand radially outward. The inner surface of locking ring 56 has biased teeth 60 which are shaped similar to the teeth of a saw blade. Each tooth 60 slopes inward and downward, then abruptly back outward. The lower end of locking ring 56 has a bevel 62 that extends from the inner diameter of ring 56 to substantially the same diameter as inner bore 54. The inner surface of locking ring 56 has notches 64 to provide a desired flexibility in locking ring 56, and to provide openings for debris to pass therethrough. Locking ring 56 has outer lips 66 extending from its lower and upper ends. Lips 66 are retained by a corresponding lip 68 on the lower end of recess 58, and a lip 70 on the lower end of a retaining ring 72, respectively. Retaining ring 72 threads into inner bore 54 above recess 58 after locking ring 56 is installed and slopes downward and inward.

A plurality of locking keys 74 extend radially inward through inner bore 54 beneath locking ring 56. Locking keys 74 retractably reside in stepped holes 78. Ridge 80 on locking key 74 engages a lip 82 in stepped hole 78 and limits inward radial movement of locking key 74. Stepped hole 78 is capped by plate 84, and a spring 86 is trapped between plate 84 and key 74, urging key 74 radially inward. The portion of locking key 74 which protrudes into bore 54 has a horizontal slot 88. Each locking key 74 has the following bevels or chamfers protruding into bore 54: upper 90, lower 92, right 94, and left 97. A small hole 96 in key 74 allows bore 54 to communicate with stepped hole 78.

Figure 3:
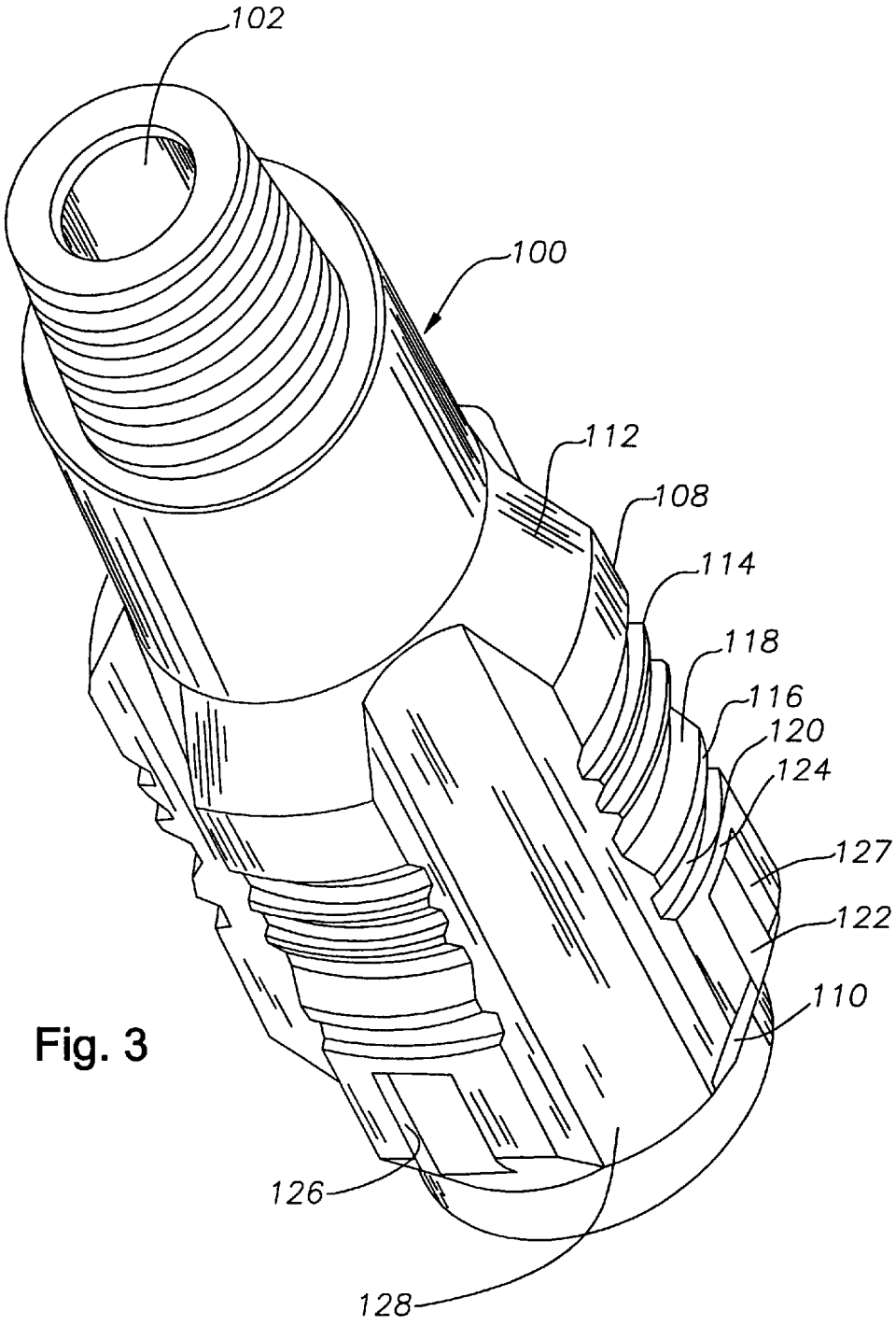
FIG. 3 is a perspective view of the running tool for the wear bushing of FIG. 1.

Running and retrieval tool 100 is generally tubular and has a bore 102. The upper end and lower ends have threads that thread onto drill pipe 98. Referring to FIG. 2, tool 100 has a plurality of axial engaging ridges 108 (four are shown). Ridges 108 have a tapered leading edge 110 on their lower end and a tapered trailing edge 112 on their upper edge. Beneath trailing edge 112 reside a plurality of biased tool teeth 114 that are similar to teeth 60, but biased the opposite direction such that they slope outward and upward then abruptly back inward. Tool teeth 114 are adapted to engage wear bushing teeth 60 when tool 100 is moved upward relative to wear bushing 28, and ratchet over wear bushing teeth 60 by flexing locking ring 56 outward when tool 100 is moved downward relative to wear bushing 28. A beveled ridge 116 (FIGS. 2 and 3) beneath teeth 114 has an upper bevel 118 that is adapted to mate with locking ring bevel 62. Beveled ridge 116 has a lower bevel 120 that is adapted to mate with the chamfer on locking key upper edge 90. An anti-rotation recess 122 (FIG. 3) located above leading edge 110 forms a support ridge 124. Anti-rotation recess 122 is sized to accept locking key 74, and the left edge of each recess 122 has a bevel 126 for mating with locking key right chamfer 94. Support ridge 124 is sized to fit in locking key horizontal slot 88 (FIG. 2). Flow passageways 128 (FIG. 3) separate each engaging ridge 108. The four flow passageways 128 are rotationally offset by 45 degrees from the outer profiles or ridges 108 to allow axial movement of tool 100 relative to wear bushing 28 in both axial directions.

In use, tool 100 is threaded into a drill string above the drill bit (not shown). Wear bushing 28 is placed on the rig floor and drill string is run through bore 54 until tool 100 reaches wear bushing 28. Tool 100 is then rotated to align anti-rotation recesses 122 with locking keys 74, and tool 100 is run into wear bushing 28. As tool 100 is inserted into wear bushing 28, slanted leading edges 110 force locking ring 56 to flex radially outward around tool 100. As tool 100 proceeds further into wear bushing 28, leading edge 110 contacts locking keys 74 and forces them radially outward around tool 100, and locking keys 74 fall into anti-rotation recesses 122. Lower bevel 120 on tool 100 to forces locking ring 56 outward until locking ring teeth 60 seat in tool teeth 114. At the same time, upper chamfer 90 of locking key 74 contacts support ridge 124 and forces key 74 radially outward, allowing key 74 to slide over ridge 124 and horizontal slot 88 to accept ridge 124. When horizontal slot 88 accepts ridge 124, locking keys 74 are locked on tool 100, and axial movement of tool 100 relative to wear bushing 28 is restrained. This also provides a positive indication that tool teeth 114 are seated in locking ring teeth 60.

With locking keys 74 locked on tool 100, wear bushing 28 is carried on tool 100 and lowered down the well into wellhead housing 10. Wear bushing 28 is landed on casing hanger 14 and locking pin 46 is pressed upward as it contacts seal assembly 26. Wear bushing 28 is rotated clockwise when viewed from above until locking pin 46 aligns and falls into slot 50. With locking pin 46 in slot 50, wear bushing 28 cannot be rotated relative to casing hanger 14. Tool 100 is then rotated 45 degrees (this embodiment can be released in either direction) to release tool 100 from wear bushing 28. Rotating tool 100 counterclockwise causes right chamfers 94 of locking keys 74 to slide over left bevels 126 of anti-rotation recesses 122 and forces locking keys 74 out of engagement with support ridges 124. Tool 100 may then be run deeper into the well as locking ring 56 will ratchet over tool teeth 114. Any equipment attached to the drill string will pass smoothly through wear bushing 28 and will not hang up on locking ring 56 because it will be deflected by bevel 62, teeth 60, and retaining ring 72. Drilling will continue with tool 100 in the drill string.

When the drill string is pulled back to the surface, wear bushing running and retrieval tool 100 is pulled upward into wear bushing 28. As tool 100 is pulled upward into bore 54 in wear bushing 28, sloped trailing edge 112 contacts bevel 62 and forces locking ring 56 radially outward around tool 100 until locking ring teeth 60 can seat in tool teeth 114. When locking teeth 60 engage tool teeth 114, wear bushing 28 is lifted with tool 100. Wear bushing 28 is lifted to the surface with the drill string, then separated from tool 100 by pushing tool 100 downward through wear bushing 28.

The present invention has several advantages. The wear bushing is designed to be run and retrieved with a tool that is placed in the bottom hole assembly. It gives positive feedback to the rig floor when it gets into position or landed, and when the wear bushing is released. The size of the tool does not interfere with the normal operation of the stabilizers. The wear bushing also incorporates a latch ring that is designed to allow for easy passage of any profile except that of the retrieval tool. In addition, there are anti-rotation pins that, along with the tool, keep the wear bushing from prematurely releasing and provide a positive indication when released.

While the invention has been shown or described in only some of its forms, it should be apparent to those skilled in the art that it is not so limited, but is susceptible to various changes without departing from the scope of the invention.

What is claimed is:

1. A downhole assembly for a well, comprising in combination:

a wellhead housing having an axial bore with a casing hanger landed therein and a seal assembly therebetween;

a wear bushing having an axial bore with an internal recess, a flexible ring located in the recess, and a radially movable key;

a tool having an outer profile; wherein the wear bushing is secured to the tool by rotating the tool and wear bushing relative to each other to align the outer profile with the key, and axially moving the tool and wear bushing relative to each other such that the tool is located in the bore of the wear bushing to engage the outer profile with the flexible ring and the key, so that the wear bushing can be landed on the casing hanger; and wherein the wear bushing is released from the tool by rotating the tool relative to the wear bushing to disengage the outer profile from the key, and lowering the tool relative to the wear bushing to disengage the outer profile from the flexible ring.

2. The downhole assembly of claim 1, further comprising spring-biased locking pins on an exterior of the wear bushing for engaging the seal assembly in the wellhead housing and preventing rotation of the wear bushing relative to the casing hanger.

3. The downhole assembly of claim 1 wherein the flexible ring and the outer profile have sets of teeth that are complementary to each other.

4. The downhole assembly of claim 1 wherein the flexible ring has notches to provide a desired flexibility and openings for debris to pass therethrough.

5. The downhole assembly of claim 1 wherein the flexible ring has lips for engaging complementary lips in the recess and on a retaining ring mounted to the wear bushing adjacent to the recess.

6. The downhole assembly of claim 1 wherein the key is located in a radial hole in the wear bushing and is spring biased into the bore of the wear bushing.

7. The downhole assembly of claim 1 wherein the key and the outer profile have complementary chamfers to allow rotation therebetween.

8. The downhole assembly of claim 1 wherein the outer profile of the tool has tapered leading and trailing edges, teeth for engaging the flexible ring, a beveled ridge for engaging the flexible ring and the key, and a support ridge with an anti-rotation recess for engaging the key, and wherein the tool has flow passageways rotationally offset from the outer profile to allow axial movement of the tool relative to the wear bushing in both axial directions.

9. The downhole assembly of claim 1 wherein the wear bushing is retrieved by elevating the tool into the bore of the wear bushing so that the outer profile engages the flexible ring, and pulling the wear bushing out of the wellhead housing with the tool.

10. A wear bushing for a casing hanger landed in and sealed to a wellhead housing, comprising:

a tubular member having an axial bore with an internal annular recess and radial holes located adjacent to the recess;

a flexible locking ring located in the recess and protruding into the axial bore, wherein the locking ring is radially movable relative to the tubular member within the recess;

a locking key located in each of the radial holes, wherein the locking keys are movably biased to protrude into the axial bore; wherein the wear bushing is adapted to be secured to a tool by rotating the tool relative to the wear bushing to align the locking keys with an outer profile of the tool, and axially moving the tool relative to and into the bore of the tubular member to engage the outer profile with the locking ring and the keys, so that the wear bushing can be landed on the casing hanger; and wherein the wear bushing is adapted to be released from the tool by rotating the tool relative to the tubular member to disengage the outer profile from the keys, and lowering the tool relative to the wear bushing to disengage the outer profile from the locking ring.

11. The wear bushing of claim 10, further comprising spring-biased locking pins on an exterior of the tubular member that are adapted to engage the seal in the wellhead housing and prevent rotation of the wear bushing relative to the casing hanger.

12. The wear bushing of claim 10 wherein the locking ring has a set of ratcheting teeth that are adapted to allow the tool to be lowered through the bore of the tubular member.

13. The wear bushing of claim 10 wherein the locking ring has notches to provide flexibility and openings for debris to pass therethrough.

14. The wear bushing of claim 10 wherein the locking ring has lips for engaging a complementary a lip in the recess and a complementary lip on a retaining ring mounted in the bore of the tubular member adjacent to the recess.

15. The wear bushing of claim 10 wherein the wear bushing is adapted to be retrieved by elevating the tool into the bore of the tubular member so that the outer profile engages the locking ring, and pulling the wear bushing out of the wellhead housing with the tool.

16. A method of installing a wear bushing in a wellhead housing having an axial bore with a casing hanger landed therein and a seal assembly therebetween, comprising the steps of:

(a) providing a tool with an outer profile, and a wear bushing having an axial bore with a recess, a flexible ring in the recess, and a radially movable key;

(b) securing the wear bushing to the tool by rotating the tool and wear bushing relative to each other to align the outer profile with the key, and axially moving the tool and wear bushing relative to each other such that the tool is located in the bore of the wear bushing to engage the outer profile with the flexible ring and the key;

(c) lowering the tool and the wear bushing into the wellhead and landing the wear bushing on the casing hanger; and then (d) releasing the wear bushing from the tool by rotating the tool relative to the wear bushing to disengage the outer profile from the key, and lowering the tool relative to the wear bushing to disengage the outer profile from the flexible ring.

17. The method of claim 16 wherein step (c) comprises locking the wear bushing to the seal assembly in the wellhead housing to prevent rotation of the wear bushing relative to the casing hanger.

18. The method of claim 16 wherein step (b) comprises engaging sets of complementary teeth on the flexible ring and the outer profile.

19. The method of claim 16, further comprising the step of retrieving the wear bushing by elevating the tool into the bore of the wear bushing until the outer profile engages the flexible ring, and then pulling the wear bushing out of the wellhead housing with the tool.

* * * * *

UNITED STATES PATENT AND TRADEMARK OFFICE

CERTIFICATE OF CORRECTION

PATENT NO. : 6,749,018 B1
DATED : June 15, 2004
INVENTOR(S) : David L. Ford et al.

It is certified that error appears in the above-identified patent and that said Letters Patent is hereby corrected as shown below:

Column 4,
Line 4, delete “to” before “forces”

Column 6,
Line 22, delete “a” before “lip in the recess”

Signed and Sealed this

Twenty-eighth Day of September, 2004

JON W. DUDAS
*Director of the United States Patent and Trademark Office*